US010836559B2

(12) United States Patent
Agerton et al.

(10) Patent No.: US 10,836,559 B2
(45) **Date of Patent: *Nov. 17, 2020**

(54) CLOSURE FOR A CONTAINER COMPRISING THREE POSITIONS

(71) Applicant: The Procter & Gamble Company, Cincinnati, OH (US)

(72) Inventors: Mark Lewis Agerton, Mason, OH (US); Brian David Andres, Harrison, OH (US); Douglas David Sena, Wyoming, OH (US)

(73) Assignee: The Procter and Gamble Company, Cincinnati, OH (US)

( * ) Notice: Subject to any disclaimer, the term of this patent is extended or adjusted under 35 U.S.C. 154(b) by 42 days.

This patent is subject to a terminal disclaimer.

(21) Appl. No.: 16/194,503

(22) Filed: Nov. 19, 2018

(65) Prior Publication Data

US 2019/0152681 A1 May 23, 2019

(30) Foreign Application Priority Data

Nov. 23, 2017 (EP) ..... 17203313

(51) Int. Cl.
*B65D 83/20* (2006.01)
*B65D 83/14* (2006.01)
(Continued)

(52) U.S. Cl.
CPC ..... *B65D 83/205* (2013.01); *B65D 41/0478* (2013.01); *B65D 83/22* (2013.01); *B65D 83/68* (2013.01); *B65D 83/753* (2013.01)

(58) Field of Classification Search
CPC ..... B65D 83/205; B65D 83/22; B65D 83/68; B65D 83/753; B65D 41/0478; B65D 50/041
(Continued)

(56) References Cited

U.S. PATENT DOCUMENTS 2,138,560 A 11/1938 Kimberly
D154,552 S 7/1949 Lauby
(Continued)

FOREIGN PATENT DOCUMENTS

AU 645214 2/1993
BQ BX25863-012 9/1995
(Continued)

OTHER PUBLICATIONS

AcaiBerry.com eco bottle packaging, google publish date Dec. 8, 2010, online, http://www.acaiberry.com/company.html, [site visitied Jun. 29, 2015 2:39:05 PM].
(Continued)

*Primary Examiner* — King M Chu
(74) *Attorney, Agent, or Firm* — Linda M. Sivik

(57) ABSTRACT

The present invention relates to a closure for a container, the closure comprising three positions. The invention further relates to a kit of parts for assembling such a closure.

The present invention relates to a closure comprising an engine and a shroud, the closure adapted to attach to the opening of a container to define an interior and an outside;

wherein the shroud and engine are adapted to engage;

wherein the closure can take a first position, a second position and a third position, wherein:

a. the shroud moves relative to the engine in a linear fashion and a different minimum force is required to move the closure from the first position to the second position than to move the closure from the second position to the first position; or b. the shroud moves relative to the engine in a linear fashion and a different minimum force is required to move the closure from the second position to the third position than to move the closure from the third position to the second position; or (Continued)

c. both a. and b.; or
d. the shroud moves relative to the engine in a rotational fashion and a different minimum torque is required to move the closure from the first position to the second position than to move the closure from the second position to the first position; or
e. the shroud moves relative to the engine in a rotational fashion and a different minimum torque is required to move the closure from the second position to the third position than to move the closure from the third position to the second position; or both d. and e.

13 Claims, 9 Drawing Sheets

(51) Int. Cl.
*B65D 83/22* (2006.01)
*B65D 83/68* (2006.01)
*B65D 41/04* (2006.01)

(58) Field of Classification Search
USPC ..... 215/220
See application file for complete search history.

(56) References Cited

U.S. PATENT DOCUMENTS

| | | | | |
|---|---|---|---|---|
| D158,396 | S | 5/1950 | Libson | |
| 2,571,833 | A | 10/1951 | Chidsey, Jr. | |
| 2,889,087 | A | 6/1959 | Paull | |
| 3,045,860 | A | 7/1962 | Edwige | |
| 3,237,571 | A | 3/1966 | Corsette | |
| 3,331,500 | A | 7/1967 | Jules | |
| 3,341,005 | A | 9/1967 | Jules | |
| 3,362,344 | A | 1/1968 | Duda | |
| D219,643 | S | 1/1971 | Garbus | |
| 3,583,605 | A | 6/1971 | Corsette | |
| 3,591,298 | A | 7/1971 | Green | |
| 3,968,914 | A | 7/1976 | Goncalves | |
| 4,172,540 | A | 10/1979 | Erichson | |
| 4,344,545 | A | 8/1982 | Aschberger | |
| 4,357,905 | A | 11/1982 | Carpenter | |
| 4,359,166 | A | 11/1982 | Dubach | |
| 4,369,899 | A | 1/1983 | Magers | |
| 4,371,088 | A | 2/1983 | Gach | |
| 4,371,099 | A | 2/1983 | Foster | |
| 4,431,110 | A | 2/1984 | Roth | |
| 4,462,504 | A | 7/1984 | Roth | |
| 4,545,495 | A | 10/1985 | Kinsley | |
| 4,609,114 | A | 9/1986 | Roy | |
| 4,610,371 | A | 9/1986 | Karkiewicz | |
| 4,625,898 | A | 12/1986 | Hazard | |
| 4,640,427 | A | 2/1987 | Marino | |
| 4,658,955 | A | 4/1987 | Eichner | |
| 4,666,068 | A | 5/1987 | Bush | |
| 4,711,372 | A | 12/1987 | Gach | |
| 4,718,567 | A | 1/1988 | La | |
| 4,749,108 | A | 6/1988 | Dornsbusch | |
| 4,852,770 | A | 8/1989 | Sledge | |
| D306,220 | S | 2/1990 | Wang | |
| D310,027 | S | 8/1990 | Bixler | |
| 4,948,002 | A | 8/1990 | Thornock | |
| D311,487 | S | 10/1990 | Platt | |
| 4,991,746 | A | 2/1991 | Schultz | |
| 5,108,029 | A | 4/1992 | Abrams | |
| 5,180,088 | A | 1/1993 | De | |
| 5,191,975 | A | 3/1993 | Pezzoli | |
| D342,023 | S | 12/1993 | Bonkowski | |
| 5,356,017 | A | 10/1994 | Rohr | |
| D353,232 | S | 12/1994 | Chrisco | |
| 5,524,793 | A | 6/1996 | Oneill | |
| 5,570,818 | A | 11/1996 | Strong | |
| 5,685,444 | A | 11/1997 | Valley | |
| 5,715,973 | A | 2/1998 | Foster | |
| 5,738,250 | A | 4/1998 | Gillingham | |
| 5,829,641 | A | 11/1998 | Bartsch | |
| 5,853,093 | A | 12/1998 | Neiger | |
| 6,039,181 | A | 3/2000 | Whiteside | |
| 6,216,905 | B1 | 4/2001 | Mogard | |
| 6,230,942 | B1 | 5/2001 | Kuo | |
| 6,283,332 | B1 | 9/2001 | Ragno | |
| 6,357,629 | B1 | 3/2002 | Ding | |
| 6,364,167 | B1 | 4/2002 | Safian | |
| 6,604,656 | B1 | 8/2003 | Tseng | |
| D502,406 | S | 3/2005 | Eddings | |
| 6,866,164 | B2 | 3/2005 | Branson | |
| D504,197 | S | 4/2005 | Huthmaker | |
| 7,164,127 | B2 | 1/2007 | Nakagaki | |
| 7,204,383 | B2 | 4/2007 | Hsu | |
| H2203 | H | 10/2007 | Burchardt et al. | |
| D576,036 | S | 9/2008 | Dell | |
| 7,611,024 | B2 | 11/2009 | Yamanaka | |
| 7,658,295 | B2 | 2/2010 | Hoepner | |
| D618,861 | S | 6/2010 | Bahnean | |
| 7,798,348 | B2 | 9/2010 | Sawyer | |
| 7,854,351 | B2 | 12/2010 | Bougamont | |
| 8,297,438 | B2 | 10/2012 | Crossman | |
| 8,403,181 | B2 | 3/2013 | Ding | |
| 8,851,305 | B2 | 10/2014 | Didehvar | |
| 8,857,638 | B2 * | 10/2014 | Brozell | B65D 50/041 215/219 |
| D717,006 | S | 11/2014 | Alfonso | |
| 8,910,817 | B2 | 12/2014 | Kanderka | |
| D722,891 | S | 2/2015 | Borg | |
| D744,819 | S | 12/2015 | Dalisay | |
| 9,908,132 | B2 | 3/2018 | Dalisay | |
| 10,099,823 | B2 | 10/2018 | Kawamura | |
| 10,640,270 | B2 | 5/2020 | Port | |
| 2001/0050264 | A1 | 12/2001 | Schorner | |
| 2003/0062369 | A1 | 4/2003 | Hierzer | |
| 2005/0045641 | A1 | 3/2005 | Doran | |
| 2005/0139500 | A1 | 6/2005 | Smithers | |
| 2005/0279746 | A1 * | 12/2005 | Hsu | B65D 39/12 220/234 |
| 2006/0011573 | A1 | 1/2006 | Herald | |
| 2006/0201905 | A1 | 9/2006 | Perrin | |
| 2008/0264961 | A1 | 10/2008 | Sawyer | |
| 2009/0101662 | A1 | 4/2009 | Marco | |
| 2009/0195401 | A1 | 8/2009 | Maroney | |
| 2010/0243511 | A1 | 9/2010 | Nicholls | |
| 2010/0308055 | A1 | 12/2010 | Sams | |
| 2011/0137272 | A1 * | 6/2011 | Adams | A61G 9/006 604/349 |
| 2011/0297700 | A1 | 12/2011 | Santagiuliana | |
| 2012/0138561 | A1 | 6/2012 | Brozell | |
| 2012/0181272 | A1 | 7/2012 | Desoto-burt | |
| 2014/0311943 | A1 | 10/2014 | Snyder | |
| 2015/0175324 | A1 | 6/2015 | Tada | |
| 2015/0315532 | A1 | 11/2015 | Bergbohm | |
| 2016/0167840 | A1 | 6/2016 | Kleppsch | |
| 2016/0172742 | A1 | 6/2016 | Forster | |
| 2017/0057703 | A1 | 3/2017 | Anderson | |
| 2017/0203889 | A1 | 7/2017 | Butter-jentsch | |
| 2018/0086521 | A1 | 3/2018 | Port | |
| 2018/0127179 | A1 | 5/2018 | Port | |
| 2019/0152682 | A1 | 5/2019 | Agerton | |

FOREIGN PATENT DOCUMENTS

| | | | |
|---|---|---|---|
| BQ | BX27419-001 | | 1/1997 |
| CN | 3670544 | | 7/2007 |
| DE | 2911988 | A1 | 10/1980 |
| EP | 0381516 | A2 | 2/1990 |
| EP | 1512634 | A1 | 3/2005 |
| EP | 1122183 | B1 | 4/2005 |
| FR | 2702739 | B1 | 6/1995 |
| FR | 2743054 | B1 | 7/1997 |
| GB | 468762 | A | 7/1937 |
| GB | 2203729 | A | 10/1988 |
| GB | 3001453 | | 3/2002 |
| GB | 2512620 | A | 10/2014 |
| JP | D1061476 | | 2/2000 |

(56) References Cited

FOREIGN PATENT DOCUMENTS

| | | | |
|---|---|---|---|
| JP | 5282241 | B2 | 9/2013 |
| WO | WO9524345 | A1 | 9/1995 |
| WO | WO0134471 | A1 | 5/2001 |

OTHER PUBLICATIONS

All final and non-final office actions for U.S. Appl. No. 14/689,569 (P&G Case 13797).
All final and non-final office actions for U.S. Appl. No. 15/718,616 (P&G Case 14518Q).
All final and non-final office actions for U.S. Appl. No. 15/718,645 (P&G Case 14519Q.
All final and non-final office actions for U.S. Appl. No. 16/194,510 (P&G Case CM4903).
All final and non-final office actions for U.S. Appl. No. 29/471,542 (P&G Case D-2153).
Berns, Applied Ergonomics, 1981, Ann Arbor Science Publishers Inc., Chap. 12.3, pp. 153-161.
Can Carrier—Dylan Macnab Portfolio, upload May 2013, online, http://cargocollective.com/dylanmacnab/Can-Carrier, [site visited Jun. 29, 2015 6:25:33 PM].
European Search Report for EP17203313.6 dated Dec. 4, 2018.
European Search Report for EP17203314.4 dated Nov. 4, 2018.
Howies Hockey Water Bottle Carrier, website copyright 2013, line, http://howieshockeytape.com/store/hockey-team-water-bottles/Hockey-Water-Bottle-Carriers, [site visited Jun. 29, 2015 6:35:14 PM].
PCT International Search Report and Written Opinion for PCT/US2016/027779 dated Jul. 25, 2016.
PCT International Search Report and Written Opinion for PCT/US2017/053873 dated Dec. 6, 2017.
PCT International Search Report and Written Opinion for PCT/US2018/058655 dated Feb. 18, 2019.
PCT International Search Report and Written Opinion for PCT/US2018/058656 dated Feb. 18, 2019.

* cited by examiner

CLOSURE FOR A CONTAINER COMPRISING THREE POSITIONS

FIELD OF THE INVENTION

The present invention relates to a closure for a container, the closure comprising three positions. The invention further relates to a kit of parts for assembling such a closure.

BACKGROUND OF THE INVENTION

With the advent of new models for selling and transporting products, a need has arisen for improved packaging methods and articles. In particular, the same products can now be purchased physically in a store, via telephone, or online, and there is a need for packaging containers which are simultaneously suitable for a range of presentation and transport activities. In the case of internet and telephone based retail, minimum sealing standards are required to ensure that product does not leak during transit. If a container can be sufficiently sealed, the need for additional sealing layers in the packaging can be dispensed with. By contrast, customers who purchase in store may desire to inspect the contents of a container in the store itself, in particular by smelling it.

One approach to providing improved closures for containers in the prior art is made in the document GB 2 339 771. Here, a flexible thread is employed for allowing flexibility in aligning a closure with a container.

Another approach is made in the document U.S. Pat. No. 5,217,130. Here, a ratchet is used for closing and a mechanism requiring a more complicated manoeuvre is used for opening.

The present invention addresses the requirement which persists in the art for a closure which is suitable for a range of retail and transport contexts.

Generally the parameter "torque" can be measured by any method useful in the context of the present invention and providing useful results. The torque values as defined in this text are generally measured by ASTM D3198, using conditioning methods 9.2 and 9.3. Suitable torque testers are, e.g., Cap Torque Testers Series TT01 or Digital Torque Gauges Series TT03C, available from Mark-10 Corporation, 11 Dixon Avenue, Copiague, N.Y. 11726 USA, or a comparable torque measurement instrument.

Generally the parameter "force" can be measured by any method useful in the context of the present invention and providing useful results. The force values as defined in this text are generally measured along the methods disclosed in ASTM E2069-00 by using a jig to hold the shroud and a spring force gauge (e.g., a Mark 10 Series 4, Series 5 or Series 6 Force Gauge, available from Mark-10 Corporation, 11 Dixon Avenue, Copiague, N.Y. 11726 USA, or a comparable spring force gauge), pushing the engine using the tip of the spring force gauge.

SUMMARY OF THE INVENTION

It is an object of the present invention to provide a closure for a container which has a reduced risk of leaking when transported.

It is an object of the present invention to provide a closure for a container which has a reduced need for additional sealing packaging when transported.

It is an object of the present invention to provide a closure for a container which allows a customer to smell the contents of the container.

It is an object of the present invention to provide a closure for a container which simultaneously satisfies two or more, preferably all of the above objects.

A contribution to at least partially solving at least one of the above mentioned objects is made by the subject matter of the following embodiments. Two or more of these embodiments can be combined, except where they are incompatible.

|1| A first Embodiment of this invention relates to a closure comprising an engine and a shroud, the closure adapted to attach to the opening of a container to define an interior and an outside;

wherein the shroud and engine are adapted to engage;

wherein the closure can take a first position, a second position and a third position, wherein:

a. the shroud moves relative to the engine in a linear fashion and a different minimum force is required to move the closure from the first position to the second position than to move the closure from the second position to the first position; or b. the shroud moves relative to the engine in a linear fashion and a different minimum force is required to move the closure from the second position to the third position than to move the closure from the third position to the second position; or c. both a. and b.; or d. the shroud moves relative to the engine in a rotational fashion and a different minimum torque is required to move the closure from the first position to the second position than to move the closure from the second position to the first position; or e. the shroud moves relative to the engine in a rotational fashion and a different minimum torque is required to move the closure from the second position to the third position than to move the closure from the third position to the second position; or f. both d. and e.

In a first aspect of this first embodiment, the shroud moves relative to the engine in a linear fashion and a greater minimum force is required to move the closure from the first position to the second position than to move the closure from the second position to the first position.

In a second aspect of this embodiment, the shroud moves relative to the engine in a linear fashion and a lesser minimum force is required to move the closure from the first position to the second position than to move the closure from the second position to the first position.

In a third aspect of this first embodiment, the shroud moves relative to the engine in a linear fashion and a greater minimum force is required to move the closure from the second position to the third position than to move the closure from the third position to the second position.

In a fourth aspect of this first embodiment, the shroud moves relative to the engine in a linear fashion and a lesser minimum force is required to move the closure from the second position to the third position than to move the closure from the third position to the second position.

In a fifth aspect of this first embodiment, the shroud moves relative to the engine in a linear fashion and a greater minimum force is required to move the closure from the first position to the second position than to move the closure from the second position to the first position and a greater minimum force is required to move the closure from the second position to the third position than to move the closure from the third position to the second position.

In a sixth aspect of this first embodiment, the shroud moves relative to the engine in a linear fashion and a greater minimum force is required to move the closure from the first position to the second position than to move the closure from the second position to the first position and a lesser minimum force is required to move the closure from the second position to the third position than to move the closure from the third position to the second position.

In a seventh aspect of this first embodiment, the shroud moves relative to the engine in a linear fashion and a lesser minimum force is required to move the closure from the first position to the second position than to move the closure from the second position to the first position and a greater minimum force is required to move the closure from the second position to the third position than to move the closure from the third position to the second position.

In an eighth aspect of this first embodiment, the shroud moves relative to the engine in a linear fashion and a lesser minimum force is required to move the closure from the first position to the second position than to move the closure from the second position to the first position and a lesser minimum force is required to move the closure from the second position to the third position than to move the closure from the third position to the second position.

In a ninth aspect of this first embodiment, the shroud moves relative to the engine in a rotational fashion and a greater minimum torque is required to move the closure from the first position to the second position than to move the closure from the second position to the first position.

In a tenth aspect of this first embodiment, the shroud moves relative to the engine in a rotational fashion and a lesser minimum torque is required to move the closure from the first position to the second position than to move the closure from the second position to the first position.

In an eleventh aspect of this first embodiment, the shroud moves relative to the engine in a rotational fashion and a greater minimum torque is required to move the closure from the second position to the third position than to move the closure from the third position to the second position. In a twelfth aspect of this first embodiment, the shroud moves relative to the engine in a rotational fashion and a lesser minimum torque is required to move the closure from the second position to the third position than to move the closure from the third position to the second position.

In a thirteenth aspect of this first embodiment, the shroud moves relative to the engine in a rotational fashion and a greater minimum torque is required to move the closure from the first position to the second position than to move the closure from the second position to the first position and a greater minimum torque is required to move the closure from the second position to the third position than to move the closure from the third position to the second position.

In a fourteenth aspect of this first embodiment, the shroud moves relative to the engine in a rotational fashion and a greater minimum torque is required to move the closure from the first position to the second position than to move the closure from the second position to the first position and a lesser minimum torque is required to move the closure from the second position to the third position than to move the closure from the third position to the second position.

In a fifteenth aspect of this first embodiment, the shroud moves relative to the engine in a rotational fashion and a lesser minimum torque is required to move the closure from the first position to the second position than to move the closure from the second position to the first position and a greater minimum torque is required to move the closure from the second position to the third position than to move the closure from the third position to the second position.

In a sixteenth aspect of this first embodiment, the shroud moves relative to the engine in a rotational fashion and a lesser minimum torque is required to move the closure from the first position to the second position than to move the closure from the second position to the first position and a lesser minimum torque is required to move the closure from the second position to the third position than to move the closure from the third position to the second position.

|2| The second embodiment relates to a closure according to embodiment |1|, wherein:

a. the closure can be moved between the first and second positions without passing through the third position;

b. the closure can be moved between the second and third positions without passing through the first positions;

c. motion between the first and third positions passes through the second position.

|3| The third embodiment relates to a closure according to any of the preceding embodiments, wherein the closure has a closed position, wherein when the closure is attached to a container and the closure is in the closed position, essentially neither gas nor liquid can pass between the interior and the outside.

|4| The fourth embodiment relates to a closure according to any of the preceding embodiments, wherein the closure has a gas-only position, wherein when the closure is attached to a container and the closure is in the gas-only position, gas can pass between the interior and the outside but liquid essentially cannot.

|5| The fifth embodiment relates to a closure according to any of the preceding embodiments, wherein the closure has an open position, wherein when the closure is attached to a container and the closure is in the open position, both gas and liquid can pass between the interior and the outside.

|6| The sixth embodiment relates to a closure according to any of the preceding embodiments;

wherein when the closure is attached to a container and the closure is in the first position, essentially neither gas nor liquid can pass between the interior and the outside. wherein when the closure is attached to a container and the closure is in the second position, gas can pass between the interior and the outside but liquid essentially cannot.

wherein when the closure is attached to a container and the closure is in the third position, both gas and liquid can pass between the interior and the outside.

The term "essentially no gas and liquid" as used in the context of the present invention means that only such amounts of gas and liquid can pass between interior and outside in any direction which the skilled person in the context of the invention would recognize as being unsubstantial.

The feature that liquids are not able to pass from the interior to the outside or from the outside to the interior as used in the context of the present invention means that under normal environmental conditions, i.e., environmental conditions under which the invention is generally used, no amounts of liquid are exchanged between the interior and the exterior which would be adverse to the storage or use of the material protected by the closure.

Throughout this disclosure, the feature of gas essentially not being able to pass from the interior to the outside preferably means an average leak rate from the interior to the outside over 10 minutes of less than 1 g/min when the container is initially charged with 1 atm (101325 Pa) argon and positioned in a chamber evacuated to a pressure of 50 mPa argon. The average leak rate over 10 minutes is preferably less than 0.01 g/min, more preferably less than 0.005 g/min. The average leak rate over 10 minutes is preferably determined as follows:

Throughout this disclosure, the feature of gas essentially not being able to pass from the outside to the interior preferably means an average leak rate from the outside to the interior over 10 minutes of less than 1 g/min when the container is initially evacuated to 50 mPa argon and positioned in a chamber charged with 1 atm (101325 Pa) argon. The average leak rate over 10 minutes is preferably less than 0.01 g/min, more preferably less than 0.005 g/min. The average leak rate over 10 minutes is preferably determined as follows:

In a first aspect of this sixth embodiment, the engine moves with respect to the shroud in a linear fashion and the minimum force required to move the closure from the closed position to the gas-only position is less than the minimum force required to move the closure from the gas-only position to the closed position;

wherein the minimum force required to move the closure from the closed position to the gas-only position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from the gas-only position to the closed position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from the gas-only position to the open position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from the open position to the gas-only position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N.

In a second aspect of this sixth embodiment, the engine moves with respect to the shroud in a linear fashion and the minimum force required to move the closure from the closed position to the gas-only position is greater than the minimum force required to move the closure from the gas-only position to the closed position;

wherein the minimum force required to move the closure from the closed position to the gas-only position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from the gas-only position to the closed position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from the gas-only position to the open position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from the open position to the gas-only position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N.

In a third aspect of this sixth embodiment, the engine moves with respect to the shroud in a linear fashion and the minimum force required to move the closure from the gas-only position to the open position is greater than the minimum force required to move the closure from the open position to the gas-only position;

wherein the minimum force required to move the closure from the closed position to the gas-only position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from the gas-only position to the closed position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from the gas-only position to the open position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from the open position to the gas-only position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N.

In a fourth aspect of this sixth embodiment, the engine moves with respect to the shroud in a linear fashion and the minimum force required to move the closure from the gas-only position to the open position is less than the minimum force required to move the closure from the open position to the gas-only position;

wherein the minimum force required to move the closure from the closed position to the gas-only position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from the gas-only position to the closed position is preferably in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from the gas-only position to the open position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from the open position to the gas-only position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N.

In a fifth aspect of this sixth embodiment, the engine moves with respect to the shroud in a linear fashion and the minimum force required to move the closure from the closed position to the gas-only position is less than the minimum force required to move the closure from the gas-only to the close position and the minimum force required to move the closure from the gas-only position to the open position is less than the minimum force required to move the closure from the open position to the gas-only position;

wherein the minimum force required to move the closure from the closed position to the gas-only position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from the gas-only position to the closed position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from the gas-only position to the open position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from the open position to the gas-only position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17

N; or in the range between 12 and 19 N, in the range between 14 and 18 N or in the range between 15 and 17 N.

In a sixth aspect of this sixth embodiment, the engine moves with respect to the shroud in a linear fashion and the minimum force required to move the closure from the closed position to the gas-only position is greater than the minimum force required to move the closure from the gas-only to the close position and the minimum force required to move the closure from the gas-only position to the open position is greater than the minimum force required to move the closure from the open position to the gas-only position;

wherein the minimum force required to move the closure from the closed position to the gas-only position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from the gas-only position to the closed position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from the gas-only position to the open position is preferably in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from the open position to the gas-only position is preferably in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N.

In a seventh aspect of this sixth embodiment, the engine moves with respect to the shroud in a rotational fashion and the minimum torque required to move the closure from the closed position to the gas-only position is less than the minimum torque required to move the closure from the gas-only position to the closed position;

wherein the minimum torque required to move the closure from the closed position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from the gas-only position to the closed position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from the gas-only position to the open position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from the open position to the gas-only position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm.

In an eighth aspect of this sixth embodiment, the engine moves with respect to the shroud in a rotational fashion and the minimum torque required to move the closure from the closed position to the gas-only position is greater than the minimum torque required to move the closure from the gas-only position to the closed position;

wherein the minimum torque required to move the closure from the closed position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from the gas-only position to the closed position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from the gas-only position to the open position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from the open position to the gas-only position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm.

In a ninth aspect of this sixth embodiment, the engine moves with respect to the shroud in a rotational fashion and the minimum torque required to move the closure from the gas-only position to the open position is greater than the minimum torque required to move the closure from the open position to the gas-only position;

wherein the minimum torque required to move the closure from the closed position to the gas-only position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from the gas-only position to the closed position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from the gas-only position to the open position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from the open position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm.

In a tenth aspect of this sixth embodiment, the engine moves with respect to the shroud in a rotational fashion and the minimum torque required to move the closure from the gas-only position to the open position is less than the minimum torque required to move the closure from the open position to the gas-only position;

wherein the minimum torque required to move the closure from the closed position to the gas-only position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from the gas-only position to the closed position is preferably in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from the gas-only position to the open position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from the open position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm.

In an eleventh aspect of this sixth embodiment, the engine moves with respect to the shroud in a rotational fashion and the minimum torque required to move the closure from the closed position to the gas-only position is less than the minimum torque required to move the closure from the gas-only to the close position and the minimum torque required to move the closure from the gas-only position to the open position is less than the minimum torque required to move the closure from the open position to the gas-only position;

wherein the minimum torque required to move the closure from the closed position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from the gas-only position to the closed position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from the gas-only position to the open position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from the open position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm.

In a twelfth aspect of this sixth embodiment, the engine moves with respect to the shroud in a rotational fashion and the minimum torque required to move the closure from the closed position to the gas-only position is greater than the minimum torque required to move the closure from the gas-only to the close position and the minimum torque required to move the closure from the gas-only position to the open position is greater than the minimum torque required to move the closure from the open position to the gas-only position;

wherein the minimum torque required to move the closure from the closed position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from the gas-only position to the closed position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from the gas-only position to the open position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from the open position to the gas-only position is preferably in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm.

|7| The seventh embodiment relates to a closure according to any of the preceding embodiments, wherein the engine has a first track and the shroud has a second track;

wherein the engine comprises a first protrusion protruding from the first trackwith a first protrusion contour profile along the first track;

wherein the shroud comprises a second protrusion protruding from the second trackwith a second protrusion contour profile along the second track;

wherein movement of the shroud between the first position and the second position causes an interaction between the first protrusion and the second protrusion.

In one aspect of this embodiment, the first protrusion contour profile is asymmetrical. In another aspect of this embodiment, the first protrusion contour profile is symmetrical.

In one aspect of this embodiment, the second protrusion contour profile is asymmetrical.

In another aspect of this embodiment, the second protrusion contour profile is symmetrical.

In one aspect of this embodiment, both the first protrusion contour profile and the second protrusion contour profile are asymmetrical. In another aspect of this embodiment, both the first protrusion contour profile and the second protrusion contour profile are symmetrical.

|8| The eighth embodiment relates to a closure according to any of the preceding embodiments, wherein the engine has a first track and the shroud has a second track;

wherein the engine or the shroud comprises a third protrusion protruding from the first or second track, respectively, with a third protrusion contour profile along the first or second track, respectively.

In one aspect of this eighth embodiment, the third protrusion contour profile is asymmetrical. In another aspect of this embodiment, the third protrusion contour profile is symmetrical.

|9| The ninth embodiment relates to a closure according to embodiment |8|, wherein the third protrusion protrudes from the first track and motion of the shroud between the second position and the third position causes an interaction between the third protrusion and the second protrusion.

|10| The tenth embodiment relates to a closure according to embodiment |8|, wherein the third protrusion protrudes from the second track and motion of the shroud between the second position and the third position causes an interaction between the third protrusion and the first protrusion.

|11| The eleventh embodiment relates to a closure according to any of the preceding embodiments, wherein the shroud and the engine are of different materials.

|11a| Embodiment 11a relates to a closure according to any of the preceding embodiments, wherein the shroud and the engine are of the same material.

In one aspect of this embodiment, the material of the shroud and engine is a plastic or a metal or a combination of both. One preferred type of plastic is a thermoplastic elastomer. Some preferred plastics are one or more selected from the group consisting of: polypropylene, polyethylene therephthalate and acrylonitrine butadiene styrene. Preferred metals are aluminium or steel or a combination of both.

|12| The twelfth embodiment relates to a closure according to any of the preceding embodiments, wherein the engine comprises a polymer of propylene or of a substituted propylene; or the shroud comprises a polymer of propylene or of a substituted propylene; or the engine and the shroud each comprises a polymer of propylene or of a substituted propylene. In a preferred aspect of this embodiment, the engine comprises a polymer of propylene or of a substituted propylene.

|13| The thirteenth embodiment relates to a closure according to any of the preceding embodiments, wherein the shroud comprises a polymer of ethylene or of a substituted ethylene; or the engine comprises a polymer of ethylene or of a substituted ethylene; or the engine and the shroud each comprises a polymer of ethylene or of a substituted ethylene. In a preferred aspect of this embodiment, the shroud comprises a polymer of ethylene or of a substituted ethylene.

|14| The fourteenth embodiment relates to a closure according to any of the preceding embodiments, wherein the shroud comprises a thermoplastic elastomer; or the engine comprises a thermoplastic elastomer; or the engine and the shroud each comprises a thermoplastic elastomer. In a preferred aspect of this embodiment, the shroud comprises a thermoplastic elastomer.

|15| The fifteenth embodiment relates to a kit of parts comprising a shroud and an engine adapted to be assembled to obtain a closure according to any of the preceding embodiments.

BRIEF DESCRIPTION OF THE FIGURES

The invention is now further described with reference to figures. This exemplary description is for illustrative purposes only and does not limit the scope of the invention.

LIST OF FIGURES

Figure 1A:
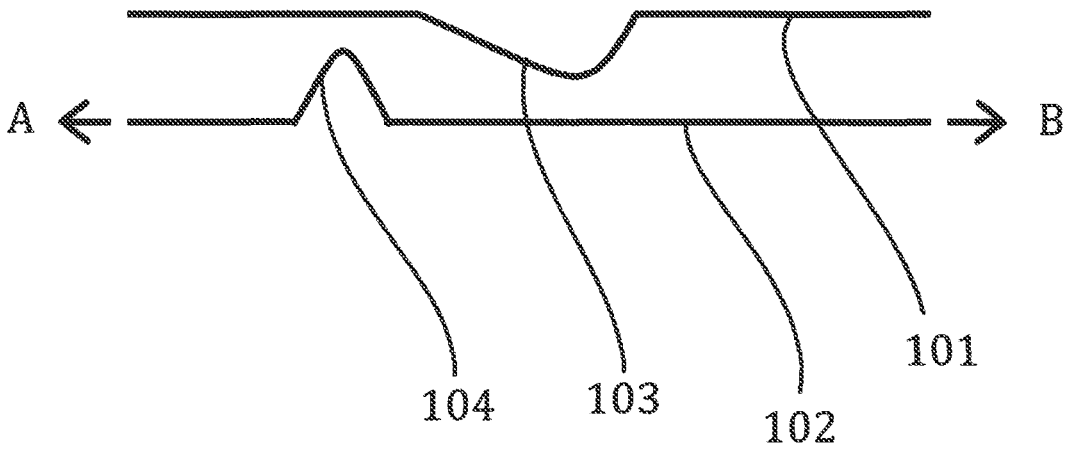

FIG. 1*a* Asymmetrical protrusion and symmetrical protrusion

Figure 1B:
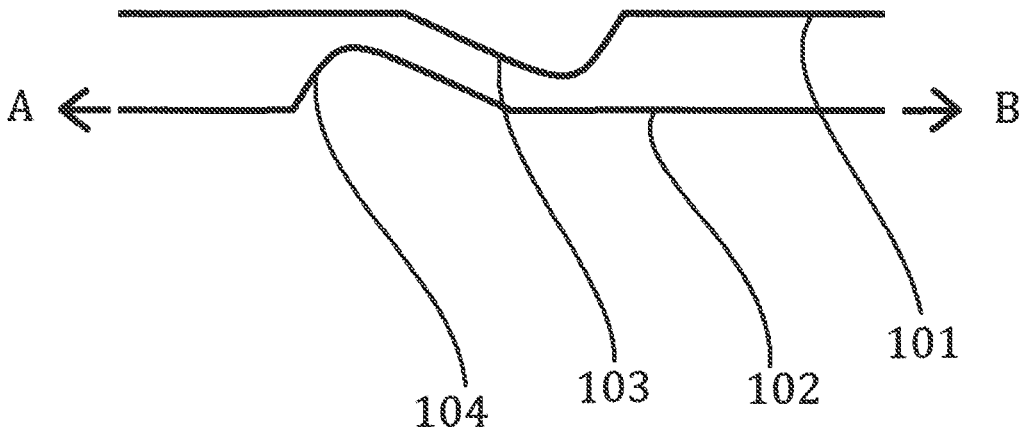

FIG. 1*b* Two asymmetrical protrusions

Figure 1C:
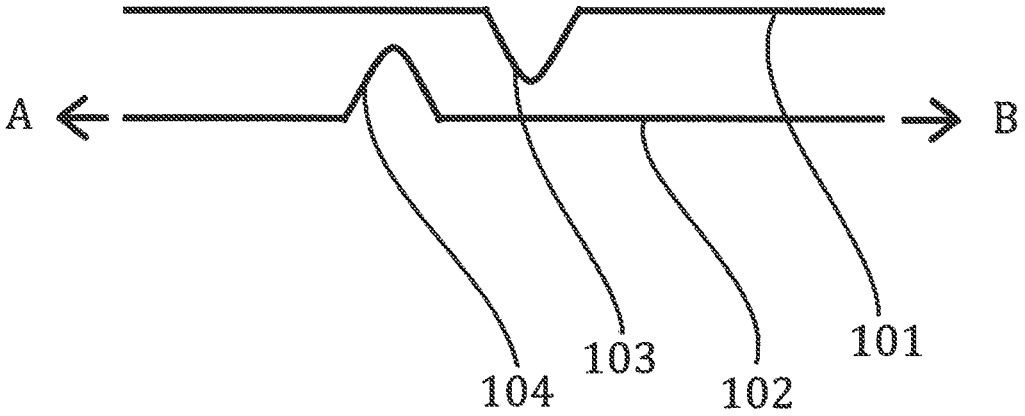

FIG. 1*c* Two symmetrical protrusions

Figure 2:
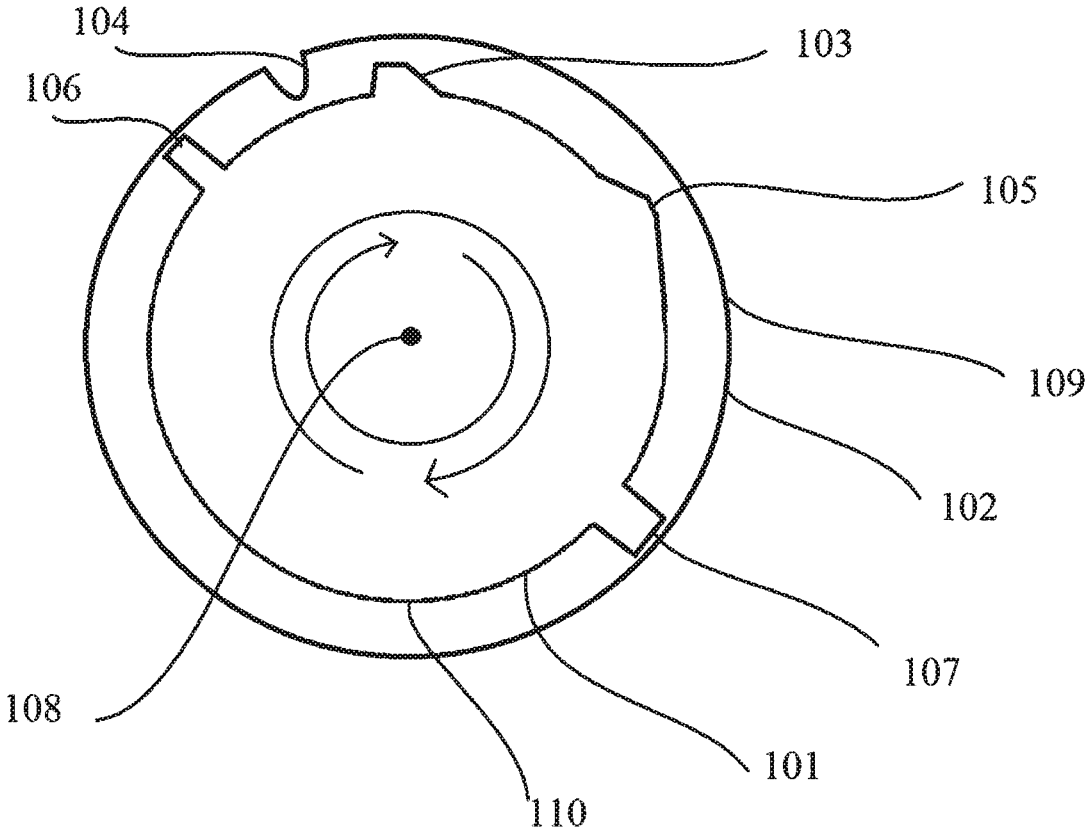

FIG. 2 Closure for rotational motion

Figure 3:
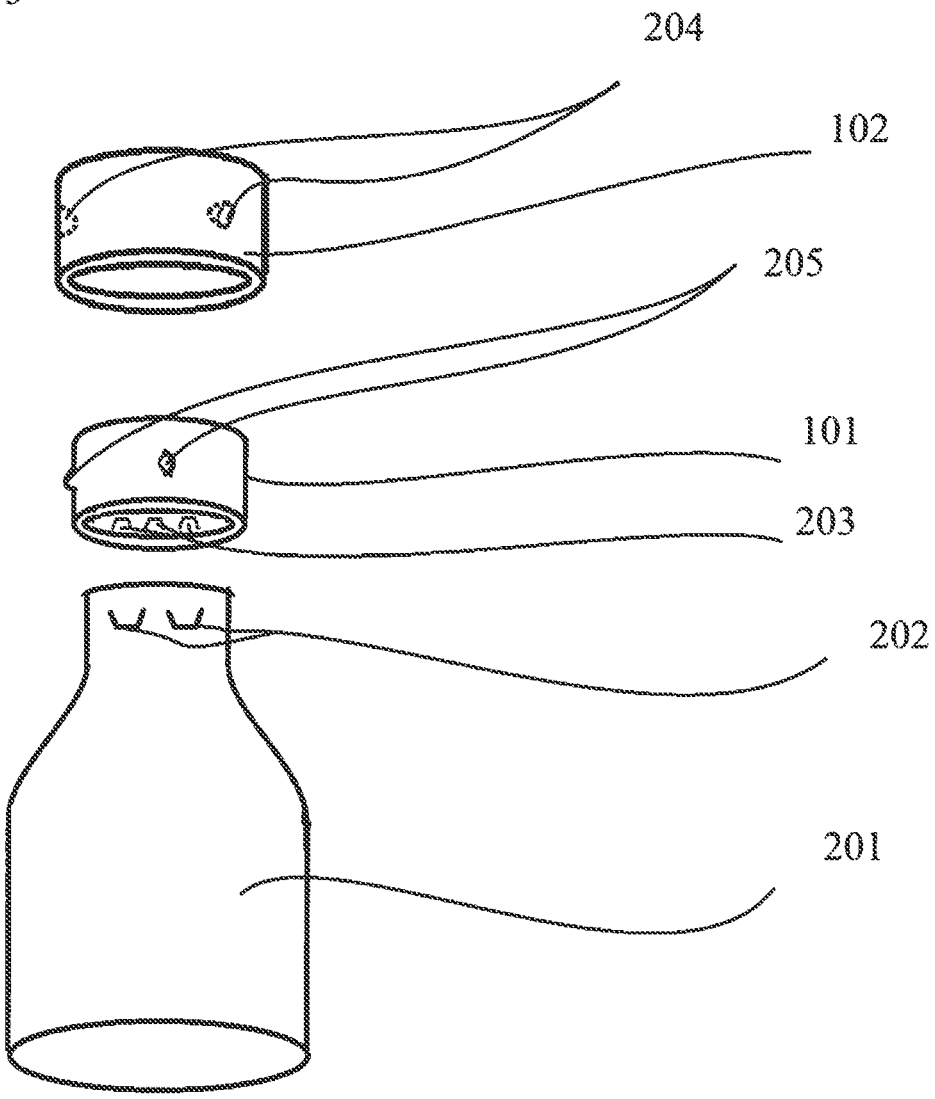

FIG. 3 Engine, shroud and container assembly

Figure 4A:
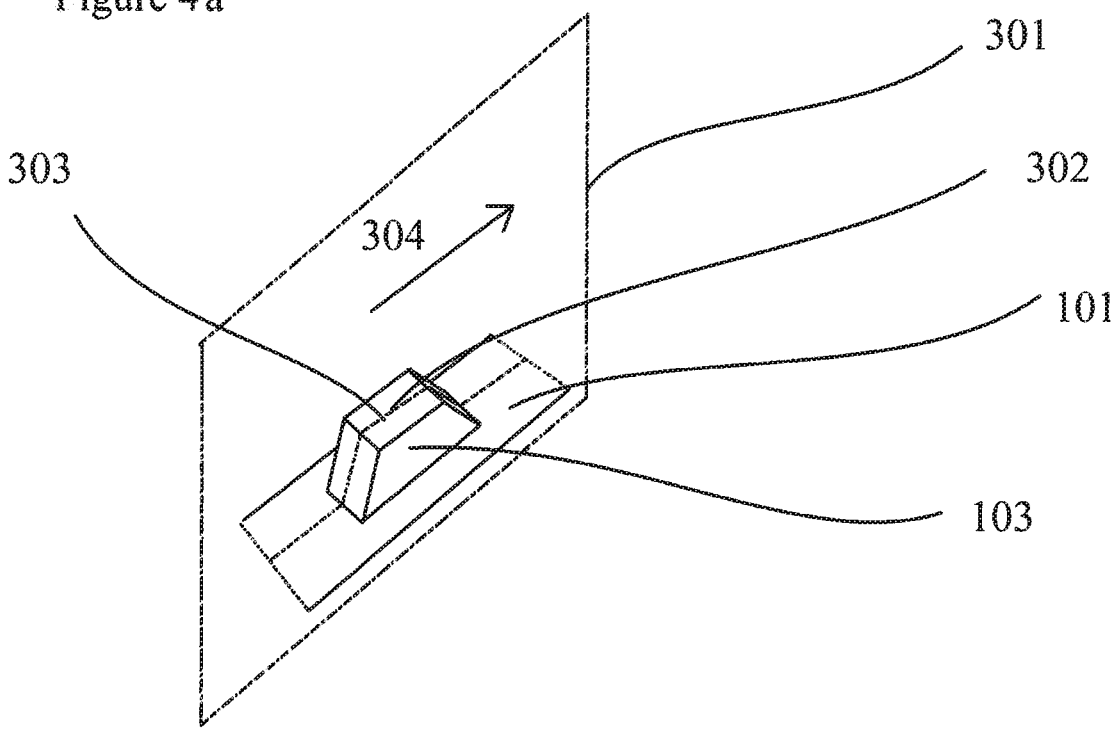

FIG. 4*a* A determination of the protrusion contour profile

Figure 4B:
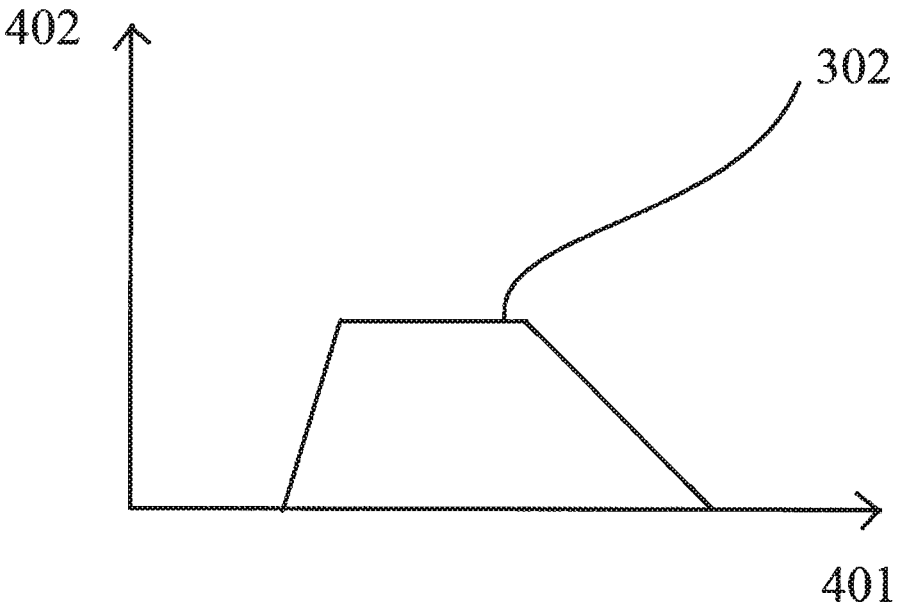

FIG. 4*b* A contour profile

Figure 5:
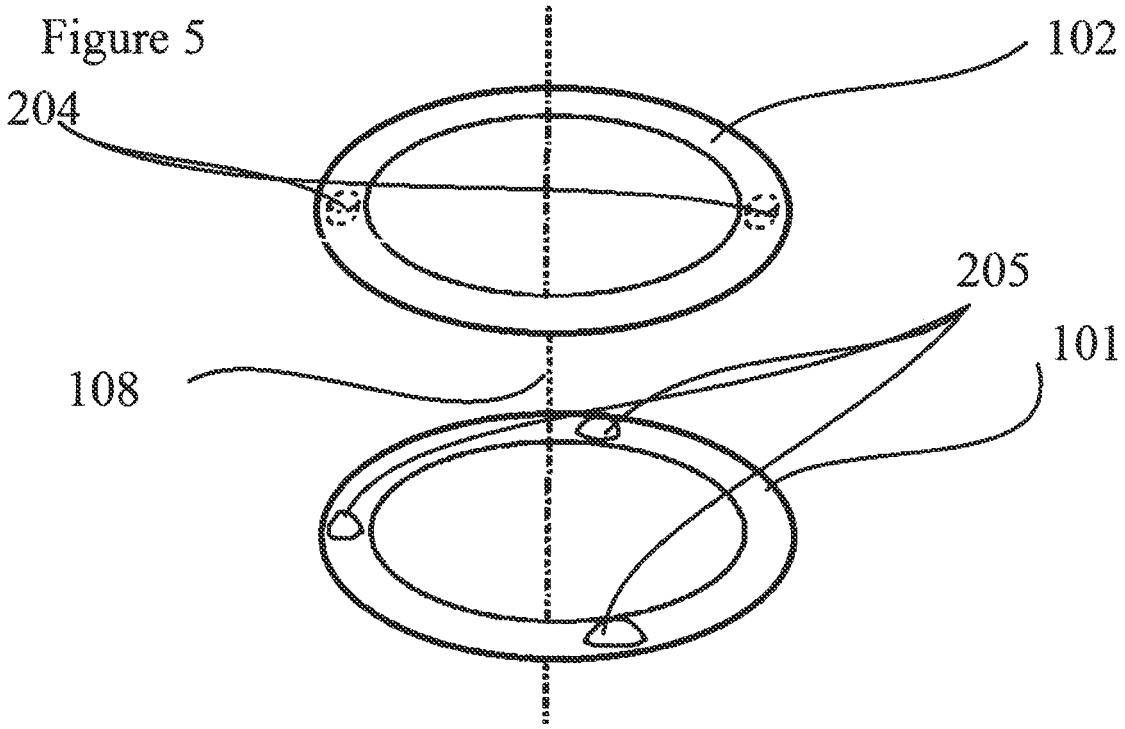

FIG. 5 Laminar ring tracks

Figure 6:
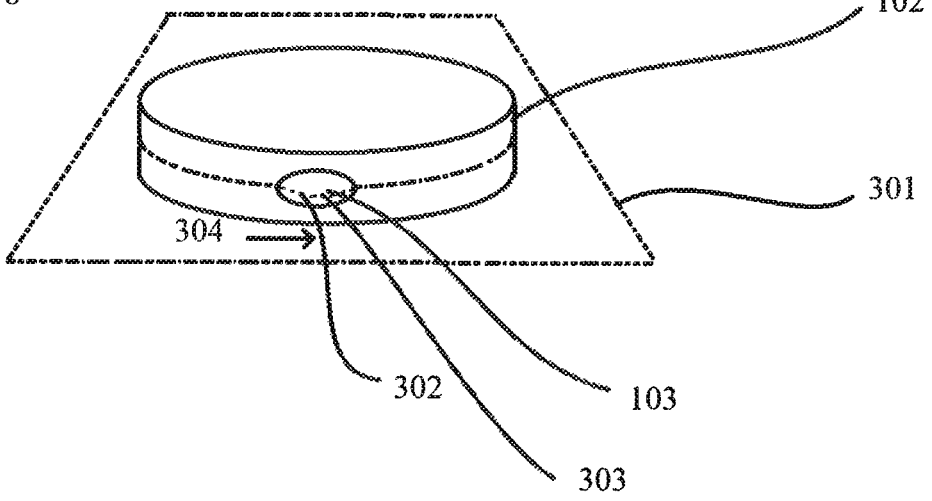

FIG. 6 Protrusion contour profile on cylindrical track

Figure 7:
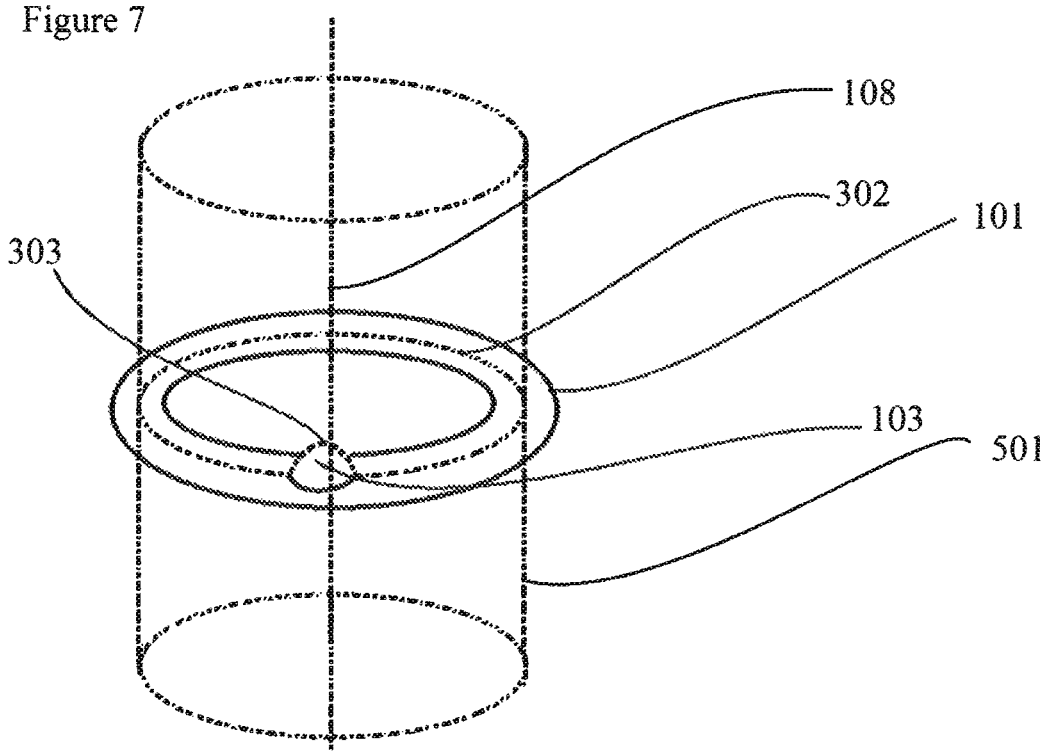

FIG. 7 Protrusion contour profile on laminar disc track

Figure 8:
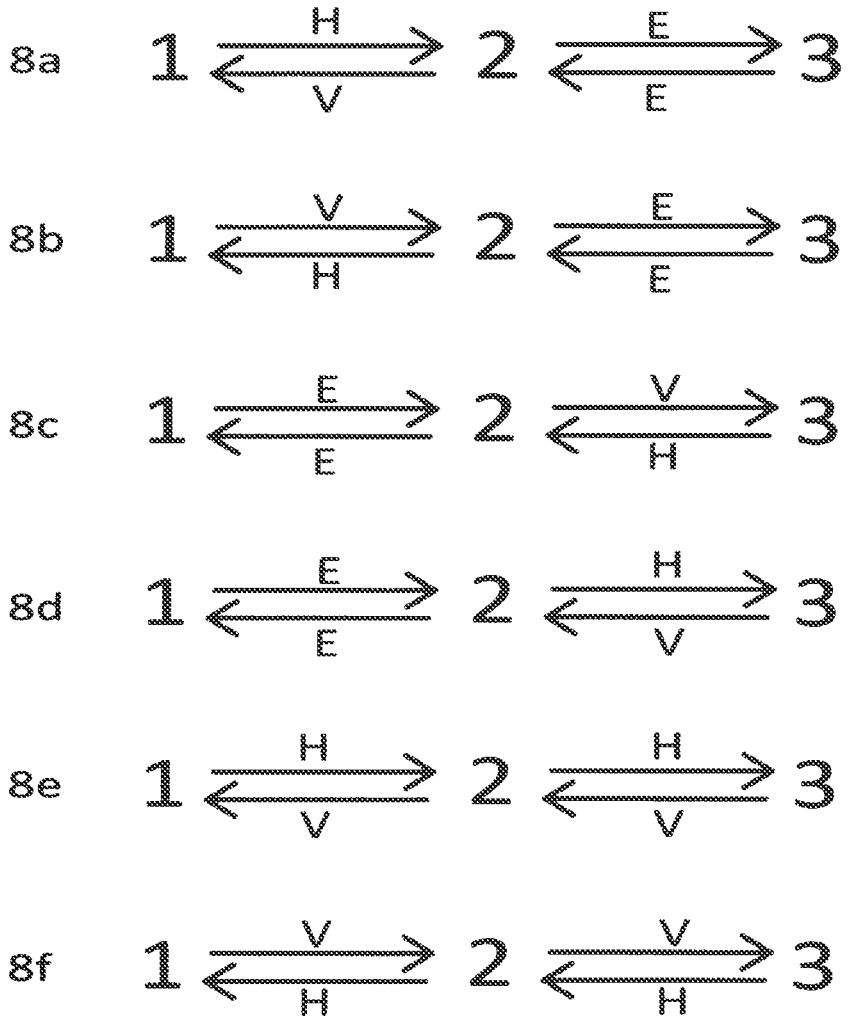

FIG. 8 Configurations of positions

DETAILED DESCRIPTION OF THE INVENTION

Closure

The closure of the present invention is for a container. A suitable container is hollow and comprises an opening, preferably one opening only. The closure is adapted to attach to the opening of the container to define an interior and an outside. The attachment of the closure to the container preferably forms a seal, such that essentially neither gas nor liquid can pass between the interior and the outside by any route other than via the closure. The closure and the opening are preferably complementary, the complementary nature of the closure and the opening serve to allow attachment of the closure to the opening. In preferred arrangements, the closure or the opening comprises one or more selected from the group consisting of: a thread, a clip, a latch, a weld, and adhesive bond; or each of the closure and the opening comprises one or more selected from the list. In one embodiment, the closure is adapted to irreversibly attach to the container. In one aspect of this embodiment, the closure once attached to the container cannot be unattached by hand. In another aspect of this embodiment, the closure once attached to the container cannot be unattached without damaging the closure or the container or both.

In one embodiment of the invention, the closure is attached to the container and a product is present in the interior. In this embodiment, the contents of the container are the product and optionally air. The product may comprise one or more selected from the group consisting of: a gas, a liquid and a solid. The product preferably comprises a liquid, more preferably the product is a liquid. In this embodiment, the contents of the container may be pressurised. It is preferred that the contents of the container are not pressurised.

The closure according to the invention comprises a shroud and an engine which are movably engaged with each other. In one embodiment, the shroud and the engine are engaged by means of a first track on the engine and a second track on the shroud. The shroud is preferably adapted for attaching to an opening of a container.

The constituent parts of the closure may be of the same material or of different materials. Preferred materials for this constituents of the closure are a plastic or a metal or a combination of both. One preferred type of plastic is a thermoplastic elastomer. Some preferred plastics are one or more selected from the group consisting of: polypropylene, polyethylene therephthalate, and acrylonitrine butadiene styrene. Preferred metals are aluminium or steel or a combination of both.

Tracks

A track is a surface with a principal direction at every point of the surface. The principal direction and the opposite direction may be designated variously as forward and reverse, positive and negative etc. A preferred track is a linear band, a circular band, or a helical thread.

In one embodiment, the track is a flat surface and the principal direction is a vector in the surface. In another embodiment, the track is the surface of a cylinder or part of the curved surface of a cylinder and the principal direction is a vector tangent to the cylinder surface and perpendicular to the axis of the cylinder. In one aspect of this embodiment, the surface of the cylinder is an external surface of the cylinder. In another aspect of this embodiment, the surface is an inner surface of the cylinder.

In one embodiment, the track is a laminar ring having its surface lying in a plane perpendicular to the axis of the ring.

According to some embodiments of the invention, both the engine and the shroud have tracks. It is preferred that a track on the shroud is complementary to a track on the engine. In one embodiment, both the engine and the shroud have a linear track. In another embodiment, both the engine and the shroud have a circular band.

A track preferably comprises one or more protruding elongate track elements extending in the direction of the track. Where a protrusion is present on a track, the protrusion may be located on a protruding elongate track element, between two protruding elongate track elements or otherwise.

Motion of the Closure

The closure according to the present invention is adapted to allow motion of the shroud with respect to the engine to allow the closure to be moved between a plurality of positions.

In one embodiment of the invention, the shroud can move with respect to the engine in an essentially linear fashion. It is preferred in this embodiment that the first track present on the engine and the second track present on the shroud are both essentially linear. In this embodiment, motion of the closure between positions is resisted by a resistive force.

In one embodiment of the invention, the shroud can move with respect to the engine in an essentially rotational fashion. It is preferred in this embodiment that the first track present on the engine and the second track present on the shroud are both essentially circular, preferably either cylindrical or disc shaped, with a common axis of rotation. In this embodiment, motion of the closure between positions is resisted by a resistive torque.

Closure Positions

According to the invention, the closure can take three or more positions. In this context, a position preferably denotes an arrangement of the shroud with respect to the engine. It is preferred for the closure to be able to take three or more positions in which no external force or torque is required to maintain the closure in each position. Preferably, the closure offers a resistive force or a resistive torque to motion from one position to another position.

In the context of the present invention, movement between positions denotes both directions of motion. Where movement between positions A and B is possible, both motion from position A to position B and motion from position B to position A is possible. Where movement between positions A and B is not possible, neither motion from position A to position B nor motion from position B to position A is possible.

In one embodiment, the closure has a closed position. In a closed position, neither gas nor liquid can pass between the interior and the outside. In one aspect of this embodiment, gas cannot pass from the interior to the outside. In another aspect of this embodiment, gas cannot pass from the outside to the interior. In another aspect of this embodiment, liquid cannot pass from the interior to the outside. In another aspect of this embodiment, liquid cannot pass from the outside to the interior. A closure which has a closed position may have one or more further closed positions.

A 10 litre chamber is prepared by evacuating to 50 mPa, filling to 1 atm (101325 Pa) with argon and evacuating again to 50 mPa. The container is prepared by evacuating to 50 mPa, filling to one atm (101325 Pa) with pure argon gas, evacuating again to 50 mPa, filling again to 1 atm (101325 Pa) with argon and attaching the closure. The prepared container is placed in the prepared chamber and left for 10 minutes with the pressure in the chamber maintained at 50 mPa. The weight of the prepared container is measured at the start and end of the 10 minutes duration and the average leak rate thereby calculated.

A 10 litre chamber is prepared by evacuating to 50 mPa, filling to 1 atm (101325 Pa) with argon, evacuating again to 50 mPa and filling again to 1 atm (101325 Pa) with argon. The container is prepared by evacuating to 50 mPa, filling to one atm (101325 Pa) with argon, evacuating again to 50 mPa, and attaching the closure. The prepared container is placed in the prepared chamber and left for 10 minutes with the pressure in the chamber maintained at 1 atm (101325 Pa) argon. The weight of the prepared container is measured at the start and end of the 10 minutes duration and the average leak rate thereby calculated.

In one embodiment, the closure has a gas-only position. In a gas-only position, gas can pass between the interior and the outside, but liquid cannot. In one aspect of this embodiment, gas can pass from the interior to the outside. In another aspect of this embodiment, gas can pass from the outside to the interior. In another aspect of this embodiment, liquid cannot pass from the interior to the outside. In another aspect of this embodiment, liquid cannot pass from the outside to the interior. A closure which has a gas-only position may have one or more further gas-only positions. Motion of gas between the interior and the outside is preferably via a path in the closure. A gas path is preferably provided by the relative positioning of the shroud and engine.

In one embodiment, the closure has an open position. In an open position, both gas and liquid can pass between the interior and the outside. In one aspect of this embodiment, gas can pass from the interior to the outside. In another aspect of this embodiment, gas can pass from the outside to the interior. In another aspect of this embodiment, liquid can pass from the interior to the outside. In another aspect of this embodiment, liquid can pass from the outside to the interior. A closure which has an open position may have one or more further open positions. Motion of liquid and gas between the interior and the outside is preferably via a path in the closure. A liquid and gas path is preferably provided by the relative positioning of the shroud and engine.

Movement of the closure between positions can be direct or indirect. Direct movement between two positions A and B does not pass through any other positions of the closure. For example, a closure which has positions A, B and C and which can move directly from position A to position B can do so without passing through position C.

In one embodiment, the positions of the closure are sequential. Sequential motion can be in an open sequence or a closed sequence. In a closed sequence, each position is connected to two other positions by direct motion and all other positions by indirect motion. In an open sequence, a first position is connected to a second position by direct motion and positions other than the second position and itself by indirect motion, last position is connected to a penultimate position by direct motion and positions other than the penultimate position and itself by indirect motion, and each position other than the start position and the last position is connected to two positions by direct motion and all positions other than those two by indirect motion.

Examples of open sequences are the following: A-B, in which direct motion between A and B is possible; A-B-C, in which direct motion is possible between A and B and between B and C, but only indirect motion is possible between A and C; A-B-C-D, in which direct motion is possible between A and B, between B and C and between C and D, but only indirect motion is possible between A and C, between A and C, between A and D and between B and D. Further examples of open sequences are A-B-C-D-E, A-B-C-D-E-F, A-B-C-D-E-F-G, A-B-C-D-E-F-G-H and A-B-C-D-E-F-G-H-I.

Examples of closed sequences are the following: -A-B-C-, in which direct motion is possible between A and B, between B and C and between C and A; -A-B-C-D-, in which direct motion is possible between A and B, between B and C, between C and D and between D and A, but only indirect motion is possible between A and C and between B and D. Further examples of open sequences are -A-B-C-D-E-, -A-B-C-D-E-F-, -A-B-C-D-E-F-G-, -A-B-C-D-E-F-G-H- and -A-B-C-D-E-F-G-H-I-.

Protrusion

According to some embodiments of the invention, the closure comprises protrusions, with one or more protrusions protruding from the first track and one or more protrusions protruding from the second track. The purpose of the protrusions is to interact during the motion of the closure between its various positions so as to bring about a resistance to the motion. An interaction is between one protrusion on the first track and one protrusion on the second track.

According to the invention, one or more of the protrusions are asymmetrical. It is preferred for the asymmetry of the protrusion or protrusions to cause an asymmetry in the resistance to motion. Asymmetry of a protrusion is manifest in an asymmetric protrusion contour profile. Protrusions may be angular or smooth. In one embodiment, the surface of the protrusion has one or more planar sections. In another embodiment, the surface of the protrusion has essentially no planar sections or no planar sections. In one embodiment, the surface of the protrusion contains one or more angular edges. In another embodiment, the surface of the protrusion contains essentially no angular edges or no angular edges.

In one embodiment, the closure comprises one or more blocking protrusions. A blocking protrusion does not allow a protrusion on the opposite track to pass it.

Protrusion Contour Profile

The protrusion contour profile for a protrusion is the extent of protrusion from the track as a function of the position along the track.

In one embodiment, the track is cylindrical or linear and the protrusion contour profile is determined in a plane perpendicular to the track which contains the point of maximum protrusion of the protrusion and a vector along the principal direction of the track. If there is more than one point of maximum protrusion, the plane closest to the line along centre of the track is selected. In an alternative embodiment, the track is a laminar ring and the protrusion contour profile is determined as the intercept of the protrusion surface with a cylindrical surface. The cylindrical surface shares an axis of rotation with the track and contains the point of maximum extent of protrusion of the protrusion.

In an alternative embodiment, the protrusion contour profile is a function of the maximum extent of protrusion from the track as a function of distance along the track. In this case, maximum extent of protrusion at a particular point in the track is determined in a cross sectional plane perpendicular to the principal direction at that point along the track.

A symmetrical protrusion contour profile for a protrusion is a protrusion contour profile which is the same when determined in the principal direction as when determined in the opposite direction. A protrusion contour profile which is not symmetrical is asymmetrical.

Configurations

In one embodiment, the closure has a position A and a position B;

wherein the minimum force required to move the closure from position A to position B is greater than the minimum force required to more the closure from position B to position A;

wherein the minimum force required to move the closure from position A to position B is in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N;

wherein the minimum force required to move the closure from position B to position A is in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N.

In one embodiment, the closure has a position C and a position D;

wherein the minimum force required to move the closure from position C to position D is greater than the minimum force required to more the closure from position D to position C; wherein the minimum force required to move the closure from position C to position D is in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from position D to position C is in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N.

In one embodiment, the closure has a position E and a position F;

wherein the minimum force required to move the closure from position E to position F is greater than the minimum force required to more the closure from position F to position E;

wherein the minimum force required to move the closure from position E to position F is in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from position F to position E is in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N.

In one embodiment, the closure has a position G and a position H;

wherein the minimum force required to move the closure from position G to position H is greater than the minimum force required to more the closure from position H to position G;

wherein the minimum force required to move the closure from position G to position H is in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N;

wherein the minimum force required to move the closure from position H to position G is in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N.

In one embodiment, the closure has a position I and a position J;

wherein the minimum force required to move the closure from position I to position J is greater than the minimum force required to more the closure from position J to position I; wherein the minimum force required to move the closure from position I to position J is in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from position J to position I is in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N.

In one embodiment, the closure has a position K and a position L;

wherein the minimum force required to move the closure from position K to position L is greater than the minimum force required to more the closure from position L to position K;

wherein the minimum force required to move the closure from position K to position L is in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N;

wherein the minimum force required to move the closure from position L to position K is in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N.

In one embodiment, the closure has a position M and a position N;

wherein the minimum torque required to move the closure from position M to position N is greater than the minimum torque required to more the closure from position N to position M;

wherein the minimum torque required to move the closure from position M to position N is in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm;

wherein the minimum torque required to move the closure from position N to position M is in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm.

In one embodiment, the closure has a position O and a position P;

wherein the minimum torque required to move the closure from position O to position P is greater than the minimum torque required to more the closure from position P to position O;

wherein the minimum torque required to move the closure from position O to position P is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from position P to position O is in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm.

In one embodiment, the closure has a position Q and a position R;

wherein the minimum torque required to move the closure from position Q to position R is greater than the minimum torque required to more the closure from position R to position Q; wherein the minimum torque required to move the closure from position Q to position R is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from position R to position Q is in the range from 0.05 to 1 Nm; e.g. in the range from 0.05 to 0.3 Nm, in the range from 0.3 to 0.7 Nm or in the range from 0.7 to 1 Nm; or in the range between 0.05 and 1 Nm; e.g. in the range between 0.05 and 0.3 Nm, in the range between 0.3 and 0.7 Nm or in the range between 0.7 and 1 Nm. It can be preferred for the minimum torque required to lie in the range from 0.1 to 0.8 Nm, in the range from 0.2 to 0.7 Nm or in the range from 0.3 to 0.6 Nm; or in the range between 0.1 and 0.8 Nm, in the range between 0.2 and 0.7 Nm or in the range between 0.3 and 0.6 Nm.

In one embodiment, the closure has a position S and a position T;

wherein the minimum torque required to move the closure from position S to position T is greater than the minimum torque required to more the closure from position T to position S;

wherein the minimum torque required to move the closure from position S to position T is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm;

wherein the minimum torque required to move the closure from position T to position S is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm.

In one embodiment, the closure has a position U and a position V;

wherein the minimum torque required to move the closure from position U to position V is greater than the minimum torque required to more the closure from position V to position U;

wherein the minimum torque required to move the closure from position U to position V is in the range from 0.15 to 2

Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from position V to position U is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.2 to 1.7 Nm, in the range from 0.4 to 1.4 Nm or in the range from 0.5 to 1.1 Nm; or in the range between 0.2 and 1.7 Nm, in the range between 0.4 and 1.4 Nm or in the range between 0.5 and 1.1 Nm.

In one embodiment, the closure has a position W and a position X;

wherein the minimum torque required to move the closure from position W to position X is greater than the minimum torque required to more the closure from position X to position W;

wherein the minimum torque required to move the closure from position W to position X is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm;

wherein the minimum torque required to move the closure from position X to position W is in the range from 0.15 to 2 Nm; e.g. in the range from 0.15 to 0.6 Nm, in the range from 0.6 to 1.4 Nm or in the range from 1.4 to 2 Nm; or in the range between 0.15 and 2 Nm; e.g. in the range between 0.15 and 0.6 Nm, in the range between 0.6 and 1.4 Nm or in the range between 1.4 and 2 Nm. It can be preferred for the minimum torque required to lie in the range from 0.4 to 1.8 Nm, in the range from 0.7 to 1.6 Nm or in the range from 1 to 1.4 Nm; or in the range between 0.4 and 1.8 Nm, in the range between 0.7 and 1.6 Nm or in the range between 1 and 1.4 Nm.

In one embodiment, the closure has a position AA and a position AB;

wherein the difference between the minimum force required to move the closure from position AA to position AB and the minimum force required to move the closure from position AB to position AB is less than 0.1 N;

wherein the minimum force required to move the closure from position AA to position AB is in the range from 3 to 10 N; e.g. in the range from 3 to 5 N, in the range from 5 to 8 N or in the range from 8 to 10 N; or in the range between 3 and 10 N; e.g. in the range between 3 and 5 N, in the range between 5 and 8 N or in the range between 8 and 10 N. It can be preferred for the minimum force required to lie in the range from 4 to 9 N, in the range from 5 to 8 N or in the range from 5.5 to 7.7 N; or in the range between 4 and 9 N, in the range between 5 and 8 N or in the range between 5.5 and 7.7 N.

In one embodiment, the closure has a position AC and a position AD;

wherein the difference between the minimum force required to move the closure from position AC to position AD and the minimum force required to move the closure from position AD to position AD is less than 0.1 N;

wherein the minimum force required to move the closure from position AC to position AD is in the range from 5 to 15 N; e.g. in the range from 5 to 8 N, in the range from 8 to 12 N or in the range from 12 to 15 N; or in the range between 5 and 15 N; e.g. in the range between 5 and 8 N, in the range between 8 and 12 N or in the range between 12 and 15 N. It can be preferred for the minimum force required to lie in the range from 6 to 13 N, in the range from 7 to 11 N or in the range from 8 to 10 N; or in the range between 6 and 13 N, in the range between 7 and 11 N or in the range between 8 and 10 N.

In one embodiment, the closure has a position AE and a position AF;

wherein the difference between the minimum force required to move the closure from position AE to position AF and the minimum force required to move the closure from position AF to position AF is less than 0.1 N;

wherein the minimum force required to move the closure from position AE to position AF is in the range from 10 to 20 N; e.g. in the range from 10 to 13 N, in the range from 13 to 17 N or in the range from 17 to 20 N; or in the range between 10 and 20 N; e.g. in the range between 10 and 13 N, in the range between 13 and 17 N or in the range between 17 and 20 N. It can be preferred for the minimum force required to lie in the range from 12 to 19 N, in the range from 14 to 18 N or in the range from 15 to 17 N; or in the range between 12 and 19 N, in the range between 14 and 18 N or in the range between 15 and 17 N.

Resistance to Motion

In various embodiments of the invention motion of the closure between its various position is resisted by a resistance. A resistance can be a resistive force or a resistive torque. In a preferred embodiment of the invention, resistance to motion is caused by a distortion of one or more parts of the closure, preferably one or more of the following: a track, a protruding elongate track element, a protrusion. A distortion may be of the engine or of the shroud or or both. A preferred distortion is a temporary distortion. A temporary distortion may be accompanied by a permanent component of distortion.

Generally the parameter "torque" can be measured by any method useful in the context of the present invention and providing useful results. The torque values as defined in this text are generally measured by ASTM D3198, using conditioning methods 9.2 and 9.3. Suitable torque testers are, e.g., Cap Torque Testers Series TT01 or Digital Torque Gauges Series TT03C, available from Mark-10 Corporation, 11 Dixon Avenue, Copiague, N.Y. 11726 USA, or a comparable torque measurement instrument.

Generally the parameter "force" can be measured by any method useful in the context of the present invention and providing useful results. The force values as defined in this text are generally measured along the methods disclosed in ASTM E2069-00 by using a jig to hold the shroud and a spring force gauge (e.g., a Mark 10 Series 4, Series 5 or Series 6 Force Gauge, available from Mark-10 Corporation, 11 Dixon Avenue, Copiague, N.Y. 11726 USA, or a comparable spring force gauge), pushing the engine using the tip of the spring force gauge.

Figure Descriptions

FIG. 1*a* shows schematically a longitudinal cross section of a first track 101 having a first protrusion 103 and a second track 102 having a second protrusion 104. The cross-sectional plane is perpendicular to the plane of both tracks and comprises the point of maximum protrusion both of the first protrusion 103 and of the second protrusion 104. The first protrusion 103 is asymmetrical and its right shoulder is steeper than its left shoulder. The second protrusion 104 is symmetrical and its left shoulder and right shoulder are equally steep. The arrangement is shown in a first position A in which the second protrusion 104 is positioned to the left of the first protrusion 103. The arrangement can be moved to a second position B in which the second protrusion 104 is to the right of the first protrusion 103. In doing so, the first protrusion 103 and the second protrusion 104 contact and bring about a resistance to the motion. In order to pass by each other, one or both of the tracks are temporarily distorted. A temporary distortion in this context may be accompanied by a permanent component of distortion. Due to the steeper right shoulder of the right protrusion 103, a greater resistance is offered to motion from B to A than from A to B.

FIG. 1*b* shows schematically a longitudinal cross section of a first track 101 having a first protrusion 103 and a second track 102 having a second protrusion 104. The cross-sectional plane is perpendicular to the plane of both tracks and comprises the point of maximum protrusion both of the first protrusion 103 and of the second protrusion 104. The first protrusion 103 is asymmetrical and its right shoulder is steeper than its left shoulder. The second protrusion 104 is asymmetrical and its right shoulder is steeper than its left shoulder. The arrangement is shown in a first position A in which the second protrusion 104 is positioned to the left of the first protrusion 103. The arrangement can be moved to a second position B in which the second protrusion 104 is to the right of the first protrusion 103. In doing so, the first protrusion 103 and the second protrusion 104 contact and bring about a resistance to the motion. In order to pass by each other, one or both of the tracks are temporarily distorted. A temporary distortion in this context may be accompanied by a permanent component of distortion. Due to the steeper right shoulder of the first protrusion 103 and the steeper left shoulder of the second protrusion 104, a greater resistance is offered to motion from B to A than from A to B.

FIG. 1*c* shows schematically a longitudinal cross section of a first track 101 having a first protrusion 103 and a second track 102 having a second protrusion 104. The cross-sectional plane is perpendicular to the plane of both tracks and comprises the point of maximum protrusion both of the first protrusion 103 and of the second protrusion 104. The first protrusion 103 is symmetrical and its left shoulder and right shoulder are equally steep. The second protrusion 104 is symmetrical and its left shoulder and right shoulder are equally steep. The arrangement is shown in a first position A in which the second protrusion 104 is positioned to the left of the first protrusion 103. The arrangement can be moved to a second position B in which the second protrusion 104 is to the right of the first protrusion 103. In doing so, the first protrusion 103 and the second protrusion 104 contact and bring about a resistance to the motion. In order to pass by each other, one or both of the tracks are temporarily distorted. A temporary distortion in this context may be accompanied by a permanent component of distortion. Since both protrusions are symmetrical, an equal resistance is offered to motion from B to A and from A to B. This corresponds to a comparative example.

FIG. 2 shows a plan cross sectional view of a closure according to the invention. The closure has an engine 110 and a shroud 109 which are engaged. The engine 110 has a first track 101. The first track 101 has a cylindrical form, this view showing a circular cross section thereof. The first track 101 has an asymmetrical first protrusion 103, an asymmetrical third protrusion 105, a blocking fourth protrusion 106 and a blocking fifth protrusion 107. The first track 101 is an exterior surface of the engine 110 and the protrusions protrude away from the axis of rotation 108. The shroud 109 has a second track 102. The second track 102 has a cylindrical form, this view showing a circular cross section thereof. The second track 102 has a symmetrical second protrusion 104. The second track 102 is an interior surface of the shroud 109 and the protrusion protrudes towards the axis of rotation 108. The first track 101 and the second track 102 share a common axis 108. The first track 101 has a smaller diameter than the second track 102 and fits inside it. The shroud 109 is movable with respect to the engine 110 by rotation about the common axis 108. The closure is shown in a first position A in which the second protrusion 104 on the second track 102 is present between the fourth protrusion 106 and the first protrusion 103. The shroud 109 is prevented from moving anticlockwise out of the position A because the second protrusion 104 cannot pass the blocking fourth protrusion 106. From position A, the closure can be moved into a position B in which the second protrusion 104 is present between the first protrusion 103 and the third protrusion 105 by moving the shroud 109 clockwise. In doing so, the second protrusion 104 passes the first protrusion 103 and interacts with it. From position B, the closure can be moved into a position A by moving the shroud 109 anticlockwise. In doing so, the second protrusion 104 passes the first protrusion 103 and interacts with it. Due to the asymmetry of the first protrusion 103, a steeper face is presented to the second protrusion 104 when it passes it in a clockwise direction than when it passes it in an anticlockwise direction. This causes the resistance to motion to be greater when moving from position A to position B than when moving from position B to position A. From position B, the closure can be moved into a position C in which the second protrusion 104 is present between the third protrusion 105 and the fifth protrusion 107 by moving the shroud 109 clockwise. In doing so, the second protrusion 104 passes the third protrusion 105 and interacts with it. From position C, the closure can be moved into a position B by moving the shroud 109 anticlockwise. In doing so, the second protrusion 104 passes the third protrusion 105 and interacts with it. Due to the asymmetry of the third protrusion 105, a steeper face is presented to the second protrusion 104 when it passes it in a clockwise direction than when it passes it in an anticlockwise direction. This causes the resistance to motion to be greater when moving from position B to position C than when moving from position C to position B. The shroud 109 is prevented from moving clockwise out of the position C because the second protrusion 104 cannot pass the blocking fifth protrusion 107.

FIG. 3 shows how a closure according to the invention may be assembled onto a container. The shroud 109 has a cylindrical form with a cylindrical inner surface. Protrusions 204, including a second protrusion 104, protrude from the inner surface of the shroud 109 towards the axis of rotation of the shroud. The engine 110 has a cylindrical form with a cylindrical outer surface. Protrusions 205, including a first protrusion 103, protrude from the outer surface of the engine 110 away from the axis of rotation of the engine. The cylindrical outer surface of the engine 110 has a smaller diameter than the inner cylindrical surface of the shroud 109 and can be introduced into it and engaged with it such that the shroud 109 cylinder and the engine 110 cylinder are co-axial. The protrusions 204 on the inside of the shroud 109 and on the outside of the engine 110 interact as the shroud 109 is rotated relative to the engine 110. The Engine 110 has latching elements 203 present on an internal cylindrical surface. These latching elements engage with latching elements 202 on an outer surface of the container 201 to attach the closure to the container 201.

FIG. 4*a* shows a determination of a protrusion contour profile. A first protrusion 103 protrudes from a first track 101. The protrusion contour profile 302 is determined in a plane 301 which is perpendicular to the plane of the track 101 and which contains the point of maximum protrusion 303 and a vector along the principal direction of the track 304.

FIG. 4*b* shows the protrusion contour profile 302 as determined in FIG. 4*a*. This is an asymmetrical protrusion contour profile, because the extent of protrusion 402 is not a symmetrical function with respect to distance along the track 401.

FIG. 5 shows an arrangement in which the first track 101 and the second track 102 are both laminar rings. The two tracks have the same inner and outer diameter of the ring and a common axis of rotation 108. In this example, the first track 101 has a protrusions 205 on its topside and the second track 102 has protrusions 204 on its underside. This arrangement is shown in exploded view and when the shroud 109 and engine 110 are engaged, the first track 101 and the second track 102 would be closer such that the protrusions 205 on the first track 101 would interact with the protrusions 204 on the second track 102 when the shroud 109 moves with respect to the engine 110 by rotation about the common axis 108.

FIG. 6 shows the determination of a protrusion contour profile 302 of a protrusion 103 on a cylindrical track 101. The protrusion contour profile 302 is determined in a plane 301 which is perpendicular to the track and contains the point of maximum extend of protrusion 303 of the protrusion 103 form the track 101 and a vector along the principal direction of the track 304.

FIG. 7 shows the determination of a protrusion contour profile 302 of a protrusion 103 on a laminar disc track 101. The protrusion contour profile 302 is determined in a cylinder 501 which shares an axis of rotation 108 with the track 101 and which contains the point of maximum extend of protrusion 303 of the protrusion 103 form the track 101.

FIG. 8 shows schematically 6 configurations of positions of a closure according to the invention. Each configuration shows a first position 1 which is a closed position, a second position 2 which is a gas-only positions, and a third positions 3 which is an open position. Movement between the positions is indicated with an arrow and each motion between two positions is denoted as easy E, hard H or very hard V, wherein an easy motion is easier to perform than a hard motion and a hard motion is easier to perform than a very hard motion. Ease of motion is either in terms of the minimum force required or in terms of the minimum torque required.

In configuration 8a, it is hard to move from the first position to the second position, very hard to move from the second position to the first position, easy to move from the second position to the third position and easy to move from the third position to the second position. Where ease of motion is in terms of force, configuration 8a corresponds to the first aspect of embodiment |6|. Where ease of motion is in terms of torque, configuration 8a corresponds to the seventh aspect of embodiment |6|.

In configuration 8b, it is very hard to move from the first position to the second position, hard to move from the second position to the first position, easy to move from the second position to the third position and easy to move from the third position to the second position. Where ease of motion is in terms of force, configuration 8b corresponds to the second aspect of embodiment |6|. Where ease of motion is in terms of torque, configuration 8b corresponds to the eighth aspect of embodiment |6|.

In configuration 8c, it is easy to move from the first position to the second position, easy to move from the second position to the first position, very hard to move from the second position to the third position and hard to move from the third position to the second position. Where ease of motion is in terms of force, configuration 8c corresponds to the third aspect of embodiment |6|. Where ease of motion is in terms of torque, configuration 8c corresponds to the ninth aspect of embodiment |6|.

In configuration 8d, it is easy to move from the first position to the second position, easy to move from the second position to the first position, hard to move from the second position to the third position and very hard to move from the third position to the second position. Where ease of motion is in terms of force, configuration 8d corresponds to the fourth aspect of embodiment |6|. Where ease of motion is in terms of torque, configuration 8d corresponds to the tenth aspect of embodiment |6|.

In configuration 8e, it is hard to move from the first position to the second position, very hard to move from the second position to the first position, hard to move from the second position to the third position and very hard to move from the third position to the second position. Where ease of motion is in terms of force, configuration 8e corresponds to the fifth aspect of embodiment |6|. Where ease of motion is in terms of torque, configuration 8e corresponds to the eleventh aspect of embodiment |6|.

In configuration 8f, it is very hard to move from the first position to the second position, hard to move from the second position to the first position, very hard to move from the second position to the third position and hard to move from the third position to the second position. Where ease of motion is in terms of force, configuration 8f corresponds to the sixth aspect of embodiment |6|. Where ease of motion is in terms of torque, configuration 8f corresponds to the twelfth aspect of embodiment |6|.

LIST OF REFERENCES IN FIGURES

101 First track
102 Second track
103 First protrusion
104 Second protrusion
105 Third protrusion
106 Fourth protrusion
107 Fifth protrusion
108 Axis of rotation
109 Shroud
110 Engine
201 Container
202 Latching elements on container
203 Latching elements on engine

204 Protrusions shroud
205 Protrusions on engine
301 Plane for determining protrusion contour profile
302 Protrusion contour profile
303 Point of maximum extent of protrusion
401 Distance along track
402 Extent of protrusion The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A closure comprising an engine and a shroud, the closure adapted to attach to the opening of a container to define an interior and an outside;

wherein the shroud and engine are adapted to engage;

wherein the closure can take a first position, a second position and a third position, wherein:

a. the shroud moves relative to the engine in a linear fashion and a different minimum force is required to move the closure from the first position to the second position than to move the closure from the second position to the first position; or b. the shroud moves relative to the engine in a linear fashion and a different minimum force is required to move the closure from the second position to the third position than to move the closure from the third position to the second position; or c. both a. and b.; or d. the shroud moves relative to the engine in a rotational fashion and a different minimum torque is required to move the closure from the first position to the second position than to move the closure from the second position to the first position; or e. the shroud moves relative to the engine in a rotational fashion and a different minimum torque is required to move the closure from the second position to the third position than to move the closure from the third position to the second position; or f. both d. and e.

2. The closure according to claim 1, wherein:

a. the closure can be moved between the first and second positions without passing through the third position;

b. the closure can be moved between the second and third positions without passing through the first positions;

c. motion between the first and third positions passes through the second position.

3. The closure according to claim 1, wherein the closure has a closed position, wherein when the closure is attached to a container and the closure is in the closed position, neither gas nor liquid can pass between the interior and the outside.

4. The closure according to claim 1, wherein the closure has a gas-only position, wherein when the closure is attached to a container and the closure is in the gas-only position, gas can pass between the interior and the outside but liquid cannot.

5. The closure according to claim 1, wherein the closure has an open position, wherein when the closure is attached to a container and the closure is in the open position, both gas and liquid can pass between the interior and the outside.

6. The closure according to claim 1;

wherein when the closure is attached to a container and the closure is in the first position, neither gas nor liquid can pass between the interior and the outside;

wherein when the closure is attached to a container and the closure is in the second position, gas can pass between the interior and the outside but liquid cannot;

wherein when the closure is attached to a container and the closure is in the third position, both gas and liquid can pass between the interior and the outside.

7. The closure according to claim 1, wherein the engine has a first track and the shroud has a second track;

wherein the engine comprises a first protrusion protruding from the first track with a first protrusion contour profile along the first track;

wherein the shroud comprises a second protrusion protruding from the second track with a second protrusion contour profile along the second track;

wherein movement of the shroud between the first position and the second position causes an interaction between the first protrusion and the second protrusion.

8. The closure according to claim 1, wherein the engine has a first track and the shroud has a second track;

wherein the engine or the shroud comprises a third protrusion protruding from the first or second track, respectively, with a third protrusion contour profile along the first or second track, respectively.

9. The closure according to claim 8, wherein the third protrusion protrudes from the first track and motion of the shroud between the second position and the third position causes an interaction between the third protrusion and the second protrusion.

10. The closure according to claim 8, wherein the third protrusion protrudes from the second track and motion of the shroud between the second position and the third position causes an interaction between the third protrusion and the first protrusion.

11. The closure according to claim 1, wherein the shroud and the engine are of different materials.

12. The closure according to claim 1, wherein the engine comprises a polymer of propylene or of a substituted propylene; or the shroud comprises a polymer of propylene or of a substituted propylene; or the engine and the shroud each comprises a polymer of propylene or of a substituted propylene, or the shroud comprises a polymer of ethylene or of a substituted ethylene; or the engine comprises a polymer of ethylene or of a substituted ethylene; or the engine and the shroud each comprises a polymer of ethylene or of a substituted ethylene, or the shroud comprises a thermoplastic elastomer; or the engine comprises a thermoplastic elastomer; or the engine and the shroud each comprises a thermoplastic elastomer.

13. A kit of parts comprising the shroud and engine adapted to be assembled to obtain the closure according to claim 1.

* * * * *